US011718102B2

(12) United States Patent
Sanada

(10) Patent No.: US 11,718,102 B2
(45) Date of Patent: Aug. 8, 2023

(54) THERMAL PRINTER

(71) Applicant: TOSHIBA TEC KABUSHIKI KAISHA, Tokyo (JP)

(72) Inventor: Tsuyoshi Sanada, Susono Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/510,423

(22) Filed: Oct. 26, 2021

(65) Prior Publication Data

US 2022/0258492 A1 Aug. 18, 2022

(30) Foreign Application Priority Data

Feb. 17, 2021 (JP) ..... 2021-023644

(51) Int. Cl.
*B41J 2/335* (2006.01)

(52) U.S. Cl.
CPC ..... *B41J 2/335* (2013.01); *B41J 2202/31* (2013.01)

(58) Field of Classification Search
CPC ..... B41J 2/335; B41J 2202/31; B41J 2/325; B41J 11/02; B41J 11/04; B41J 11/053; B41J 11/057; B41J 11/06; B41J 11/08; B41J 11/10; B41J 11/13
See application file for complete search history.

(56) References Cited

FOREIGN PATENT DOCUMENTS

JP 1989-072763 5/1989

*Primary Examiner* — Kristal Feggins
(74) *Attorney, Agent, or Firm* — Amin, Turocy & Watson, LLP

(57) ABSTRACT

A thermal printer includes: a platen having a rotatable columnar shape and configured to convey a print medium having various widths by bringing the print medium into contact with an outer peripheral portion of the platen, a central portion of the platen in a direction of a rotary shaft of the platen being taken as a reference; and a print head facing the platen, pressed by the outer peripheral portion, and configured to print by applying heat to the print medium sandwiched between the print head and the outer peripheral portion. In the outer peripheral portion of the platen, a first groove is formed in a direction intersecting the direction of the rotary shaft in each of second outer peripheral portions on both outer sides in the direction of the rotary shaft with respect to a first outer peripheral portion in contact with the print medium having a smallest width that can be conveyed.

20 Claims, 7 Drawing Sheets

THERMAL PRINTER

CROSS-REFERENCE TO RELATED APPLICATION

This application is based upon and claims the benefit of priority from Japanese Patent Application No. 2021-023644, filed on Feb. 17, 2021, the entire contents of which are incorporated herein by reference.

FIELD

Embodiments described herein relate generally to a thermal printer.

BACKGROUND

In a thermal printer that prints by conveying a sheet such as a label or a receipt, printing is performed on the sheet by a printing unit including a print head in which heat-generating elements are arranged in a line and a platen.

Such a thermal printer uses sheets of various sizes according to applications, sandwiches the sheet between the print head and the platen, and conveys the sheet by rotating the platen.

This thermal printer uses a wide print head and a wide platen so that even large-size printing can be performed. Therefore, when the thermal printer prints on a sheet having a small size (width), printing is performed near a center of the printing unit, and thus there is no sheet at both end portions of the print head, and the rotating platen is in direct contact with the print head.

At this time, frictional resistance generated between the print head and the platen causes a load when the sheet is conveyed, which has a negative effect on sheet conveyance.

DETAILED DESCRIPTION

In general, according to one embodiment, a thermal printer capable of reducing a load of sheet conveyance due to frictional resistance is provided.

A thermal printer according to an embodiment includes: a platen having a rotatable columnar shape and configured to convey a print medium having various widths by bringing the print medium into contact with an outer peripheral portion of the platen, a central portion of the platen in a direction of a rotary shaft being taken as a reference; and a print head facing the platen, pressed by the outer peripheral portion, and configured to print by applying heat to the print medium sandwiched between the print head and the outer peripheral portion. In the outer peripheral portion of the platen, a first groove is formed in a direction intersecting the direction of the rotary shaft in each of second outer peripheral portions on both outer sides in the direction of the rotary shaft with respect to a first outer peripheral portion in contact with the print medium having a smallest width that can be conveyed.

Hereinafter, a thermal printer according to an embodiment will be described in detail. In the embodiment, a label sheet formed of thermal paper is described as an example of a print medium. Further, the embodiment is not limited to the embodiment described below.

Figure 1:
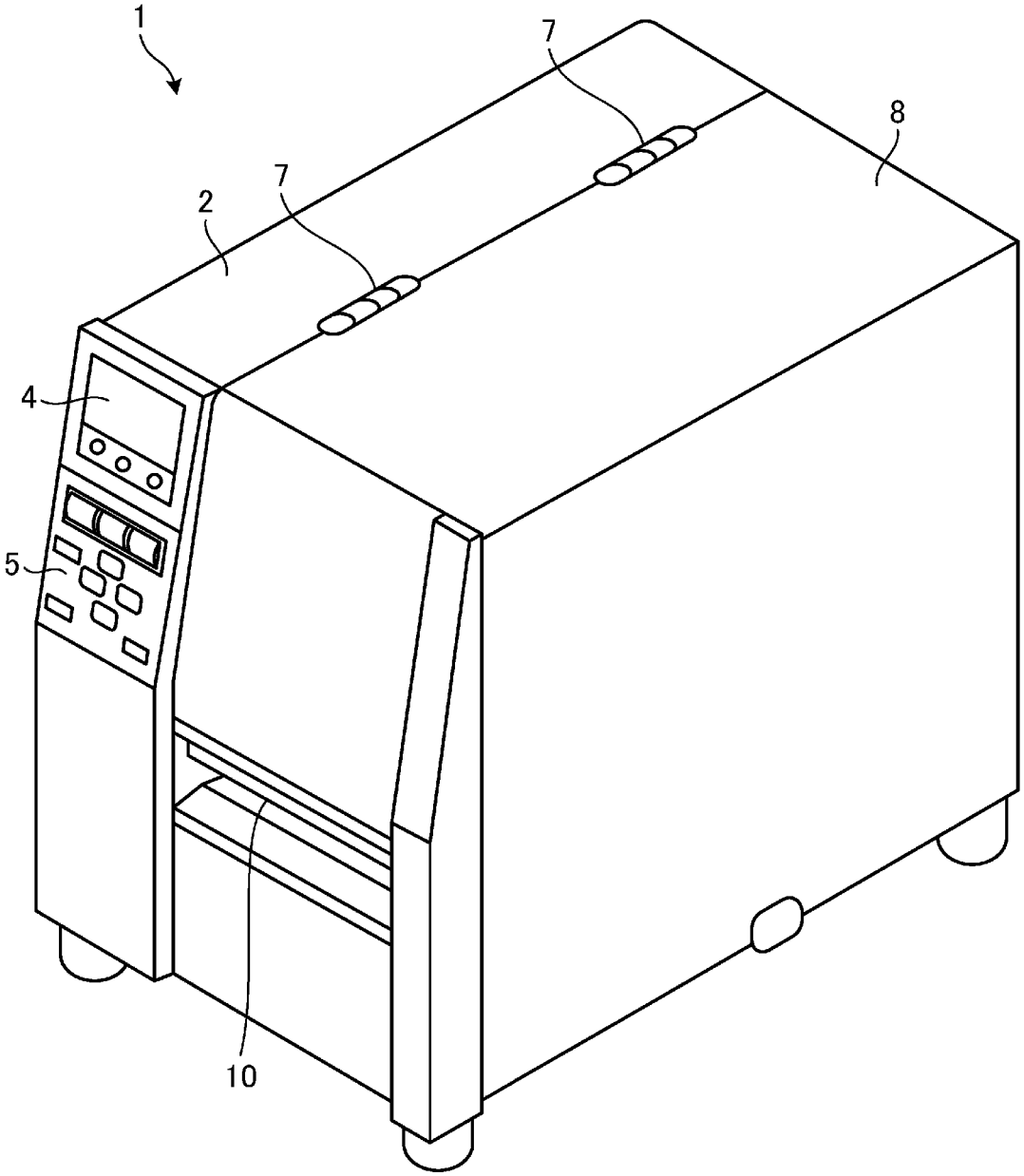
FIG. 1 is an external perspective view of a printer according to an embodiment.

FIG. 1 is an external perspective view of a thermal printer 1 according to the embodiment. As illustrated in FIG. 1, the thermal printer 1 includes a case 2 on a left side and a case 8 coupled to a right side of the case 2 by hinges 7. A front panel 3 of the case 2 includes a display unit 4 and an operation unit 5. The display unit 4 is constituted by a liquid crystal display with a backlight, and other types of display devices may also be used.

The case 8 on the right side has a structure in which an inside of a housing (i.e., cases 2 and 8) can be widely opened from a side surface side by the case 8 pivoting on the hinges 7. As will be described later with reference to FIG. 2, the thermal printer 1 includes a label sheet (print medium) 20 wound in a roll and a printing unit 23 that prints on a label inside the housing. Pivoting the case 8 on the hinges 7 and moving the case 8 upward can facilitate replacement of the label sheet 20 or internal maintenance. A front panel 9 of the case 8 is provided with a label issuing port 10. The thermal printer 1 issues labels after printing from the label issuing port 10.

Figure 2:
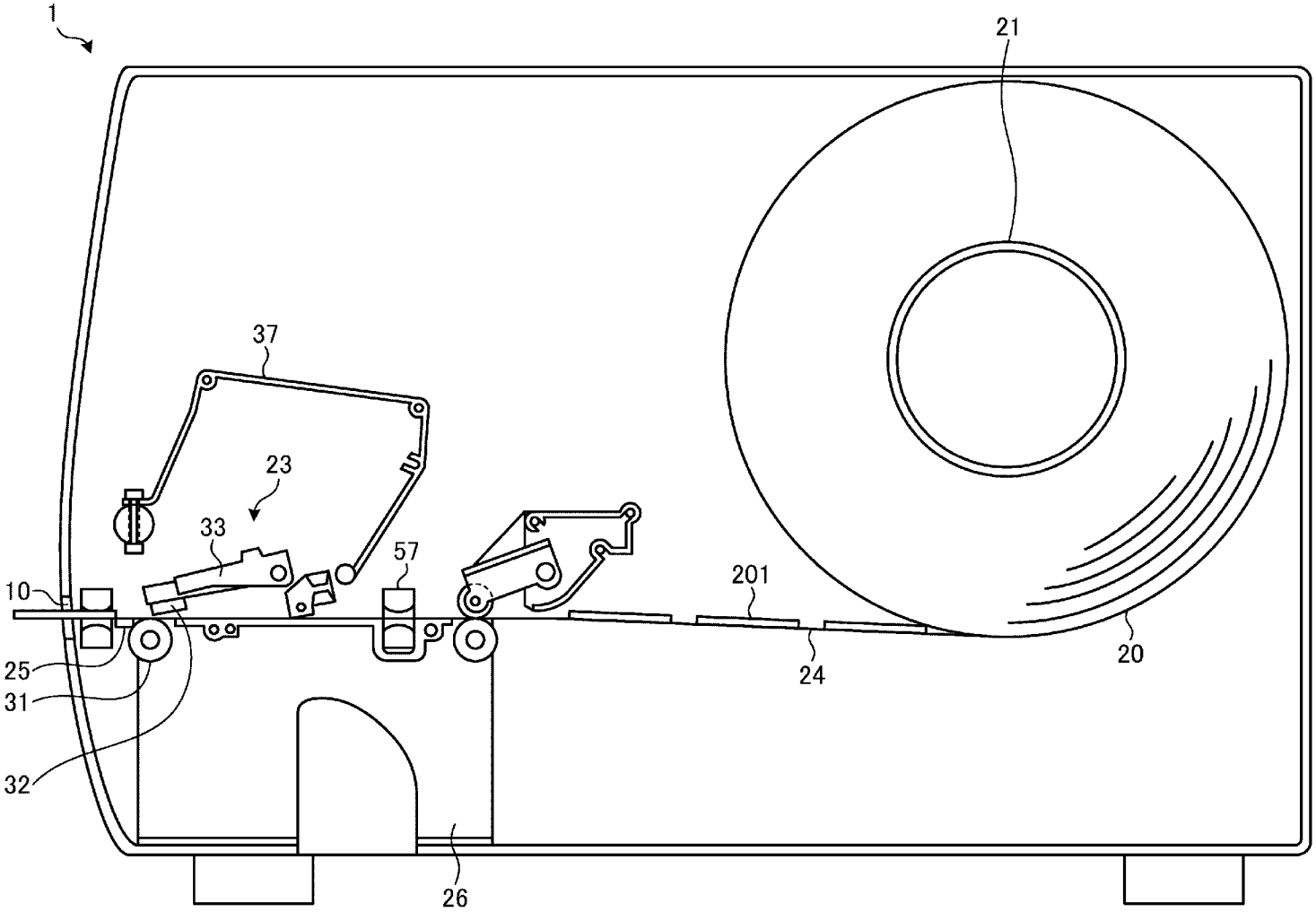
FIG. 2 is a schematic side cross-sectional view illustrating an internal configuration of the printer.

FIG. 2 is a schematic side cross-sectional view illustrating an internal configuration of the thermal printer 1. As illustrated in FIG. 2, the thermal printer 1 mainly includes a sheet holding unit 21, the printing unit 23, and a frame 26 inside the housing thereof.

The sheet holding unit 21 is a shaft that holds the label sheet 20 wound in a roll together with a liner. The label sheet 20 is pulled out from the sheet holding unit 21, printed by the printing unit 23, and then discharged from the label issuing port 10. An example of the label sheet 20 can include a label sheet in which a label 201 is attached to the liner.

A conveyance path 24 is a path through which the label sheet 20 pulled out from the sheet holding unit 21 is conveyed to positions of a print head 32 and a platen 31 to be described later. The conveyance path 24 also includes a sheet detection unit 57 that detects the pulled out label 201. The sheet detection unit 57 is located along the conveyance path 24 between a position where the label 201 is pulled out and the print head 32 and the platen 31 to be described later.

A label peeling plate 25 is provided downstream of the printing unit 23 on the conveyance path 24 in a conveyance direction. The label peeling plate 25 bends the liner of the label sheet 20 during conveyance at an acute angle and peels off the label 201 and the liner. The liner is wound around a winding shaft (not illustrated), while the label 201 peeled off from the liner is issued from the label issuing port 10.

The printing unit 23 mainly includes the print head 32 that is a line-type thermal head in which heat-generating elements are disposed in a line in a direction (that is, a width direction of the label 201) substantially orthogonal to the conveyance direction of the label 201. The platen 31 having a columnar shape is rotatably attached to the frame 26, and is rotated by being driven by a platen motor (not illustrated).

The print head 32 is fixed to a head holding unit 33 rotatably attached to a frame (not illustrated). The print head 32 is biased in a direction in which the print head 32 presses against the platen 31 accompanying a rotation operation of the head holding unit 33, and abuts against and separates from the platen 31. The thermal printer 1 includes a head-up mechanism for heading the print head 32 up and a head abutment mechanism for abutting the print head 32 against the platen (neither of the mechanisms is illustrated). When the head-up mechanism is operated, the print head 32 is separated from the platen 31. When the head abutment mechanism is operated, the print head 32 is biased (pressed) in the direction toward the platen 31 and is abutted against the platen 31.

Figure 3:
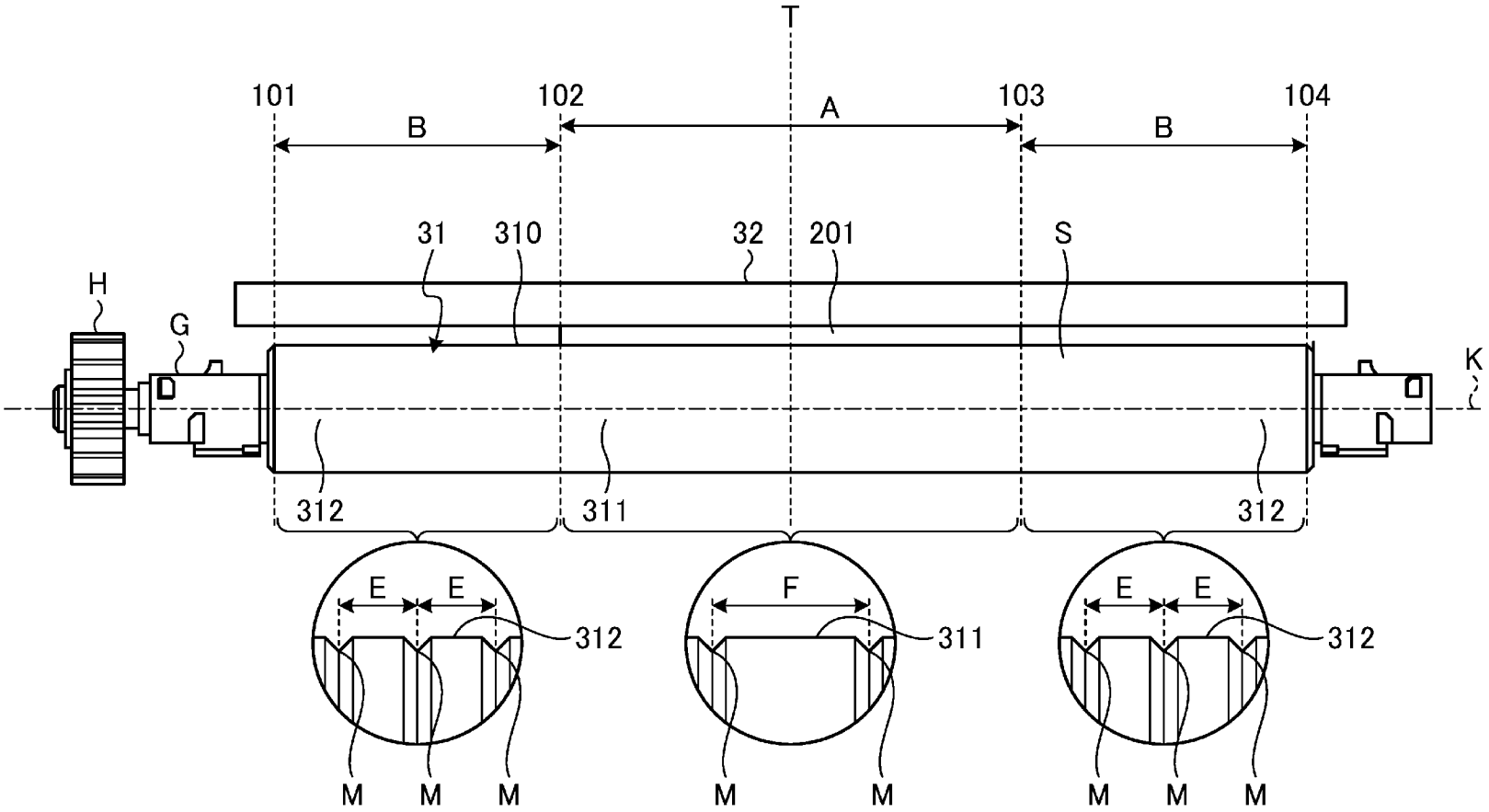
FIG. 3 illustrates an example of a structure of a platen.

Hereinafter, the platen 31 will be described. FIG. 3 illustrates an example of a structure of the platen 31. As illustrated in FIG. 3, the platen 31 and the print head 32 are disposed to face each other. The print head 32 prints characters, figures, and the like on the label 201 by selectively heating the heat-generating elements (not illustrated) arranged along the print head 32 (that is, in a direction of a rotary shaft G of the platen 31). The label 201 (to be exact, the label 201 and the liner (not illustrated) to which the label 201 is attached) is sandwiched between the platen 31 and the print head 32.

The platen 31 includes a rod-shaped rotary shaft G, a conveyance unit S formed around the rotary shaft G, and a gear H. The rotary shaft G is made of, for example, metal. The conveyance unit S has a columnar shape by, for example, pouring molten hard rubber into a mold about the rotary shaft G, solidifying the hard rubber, and polishing the hard rubber to obtain an accurate diameter. The formed conveyance unit S has an elastic function. The gear H is fixed to the rotary shaft G. The platen 31 is rotatably attached with the rotary shaft G being fitted into the frame 26. When power is transmitted from the platen motor to the gear H, the rotary shaft G of the platen 31 rotates about an axial center K. Rotation of the rotary shaft G causes the platen 31 to rotate. When the platen 31 rotates, the conveyance unit S conveys the label 201 sandwiched between the platen 31 and the print head 32.

The conveyance unit S of the platen 31 includes an outer peripheral portion 310 on a peripheral surface. The outer peripheral portion 310 is abutted against the sandwiched label 201 (to be exact, the liner). The platen 31 conveys the label 201 with a central portion T (a position denoted by a dotted line T) of the conveyance unit S in the direction of the rotary shaft G as a reference. That is, the platen 31 conveys the label 201 with a central portion of the label 201 in the width direction taking the position of the central portion T as a reference regardless of a length (the width of the label 201, to be exact, the width of the liner, hereinafter referred to as the "width of the label") of the label 201 in a direction orthogonal to the conveyance direction of the label 201 to be conveyed. That is, the platen 31 conveys the label 201 with reference to the center.

FIG. 3 illustrates a state in which the platen 31 conveys the label 201 having the smallest label width that can be conveyed. The outer peripheral portion 310 of the platen 31 includes a first outer peripheral portion 311 and second outer peripheral portions 312. The first outer peripheral portion 311 is a portion (a portion between a dotted line 102 and a dotted line 103 in which the dotted line T is included) of the outer peripheral portion 310 from the central portion T to positions on both sides away from the central portion T by a distance of A/2. A distance A between the dotted line 102 and the dotted line 103 is substantially equal to the width of the label 201 having the smallest label width. As illustrated in FIG. 3, the label 201 having the smallest label width is conveyed between the dotted line 102 and the dotted line 103 with the central portion T as the center.

The second outer peripheral portions 312 are located on both sides of the first outer peripheral portion 311 in the direction of the rotary shaft G. One of the second outer peripheral portions 312 is a portion of the outer peripheral portion 310 having a distance B between a dotted line 101 and the dotted line 102. The other one of the second outer peripheral portions 312 is a portion of the outer peripheral portion 310 having a distance B between the dotted line 103 and a dotted line 104. The second outer peripheral portions 312 are located outside a region in which the label 201 having the smallest label width is conveyed. In other words, the second outer peripheral portions 312 are not used to convey the label 201 having the smallest label width. A length of the conveyance unit S in the direction of the rotary shaft G equals to distance A+distance B+distance B.

As illustrated in FIG. 3, in the embodiment, a plurality of annular grooves M (second grooves) are formed in the first outer peripheral portion 311 of the platen 31. Each of the grooves M has a depth of, for example, 0.05 mm to 0.15 mm and an angle of approximately 90°. An interval between the grooves M is an interval F (a second predetermined interval). In FIG. 3, the grooves M are enlarged and illustrated in a circle for illustration, and the grooves Mare actually formed in the first outer peripheral portion 311. The same applies to FIGS. 4 and 5 (in FIGS. 6 and 7, no groove M is formed in the first outer peripheral portion 311).

In the embodiment, a plurality of annular grooves M (first grooves) are formed in the second outer peripheral portions 312 on both sides of the platen 31. The grooves M have the same shape as that of the grooves M formed in the first outer peripheral portion 311. An interval between the grooves M is an interval E (a first predetermined interval). The interval E is smaller than the interval F, and is an interval of, for example, about 1 mm. In FIG. 3, the grooves M are enlarged and illustrated in a circle for illustration, and the grooves M are actually formed in the second outer peripheral portions 312. The same applies to FIGS. 4 to 7.

That is, in the platen 31, a plurality of grooves M are formed at the interval E between the dotted line 101 and the dotted line 102, a plurality of grooves M are formed at the interval F between the dotted line 102 and the dotted line 103, and a plurality of grooves M are formed at the interval E between the dotted line 103 and the dotted line 104. In other words, in the platen 31, the grooves M are formed at a large interval between the dotted line 102 and the dotted line 103 (the first outer peripheral portion 311) where the central portion is provided, and the grooves M are formed at an interval smaller than the interval in the central portion between the dotted line 101 and the dotted line 102 (the second outer peripheral portion 312) and between the dotted line 103 and the dotted line 104 (the second outer peripheral portion 312) where two outer sides are provided.

In this embodiment, when the platen 31 is rotated and the label 201 having the smallest label width is sandwiched and conveyed between the platen 31 and the print head 32, the label 201 is conveyed between the dotted line 102 and the dotted line 103 (the first outer peripheral portion 311). However, the label 201 is not present between the dotted line 101 and the dotted line 102 (the second outer peripheral portion 312) or between the dotted line 103 and the dotted line 104 (the second outer peripheral portion 312). Since the print head 32 is biased in the direction toward the platen 31, the print head 32 and the platen 31 are in direct contact with each other at a position between the dotted line 101 and the dotted line 102 and a position between the dotted line 103 and the dotted line 104 except for positions near both end portions of the label 201. However, a plurality of grooves M are formed at the interval E at positions between the dotted line 101 and the dotted line 102 and positions between the dotted line 103 and the dotted line 104. The interval E is smaller than the interval F. Therefore, at the positions between the dotted line 101 and the dotted line 102 and at the positions between the dotted line 103 and the dotted line 104, since a contact area of the print head 32 and the platen 31 is smaller than a contact area of the print head 32 and the platen 31 between the dotted line 102 and the dotted line 103, frictional resistance caused by sliding between the print head 32 and the platen 31 due to the rotation of the platen 31 can be reduced.

A plurality of grooves M are formed at the interval F between the dotted line 102 and the dotted line 103. Therefore, the contact area between the platen 31 and the label 201 can be increased. Therefore, even if the label 201 is sandwiched between the print head 32 and the platen 31, the label 201 can be conveyed stably.

Figure 4:
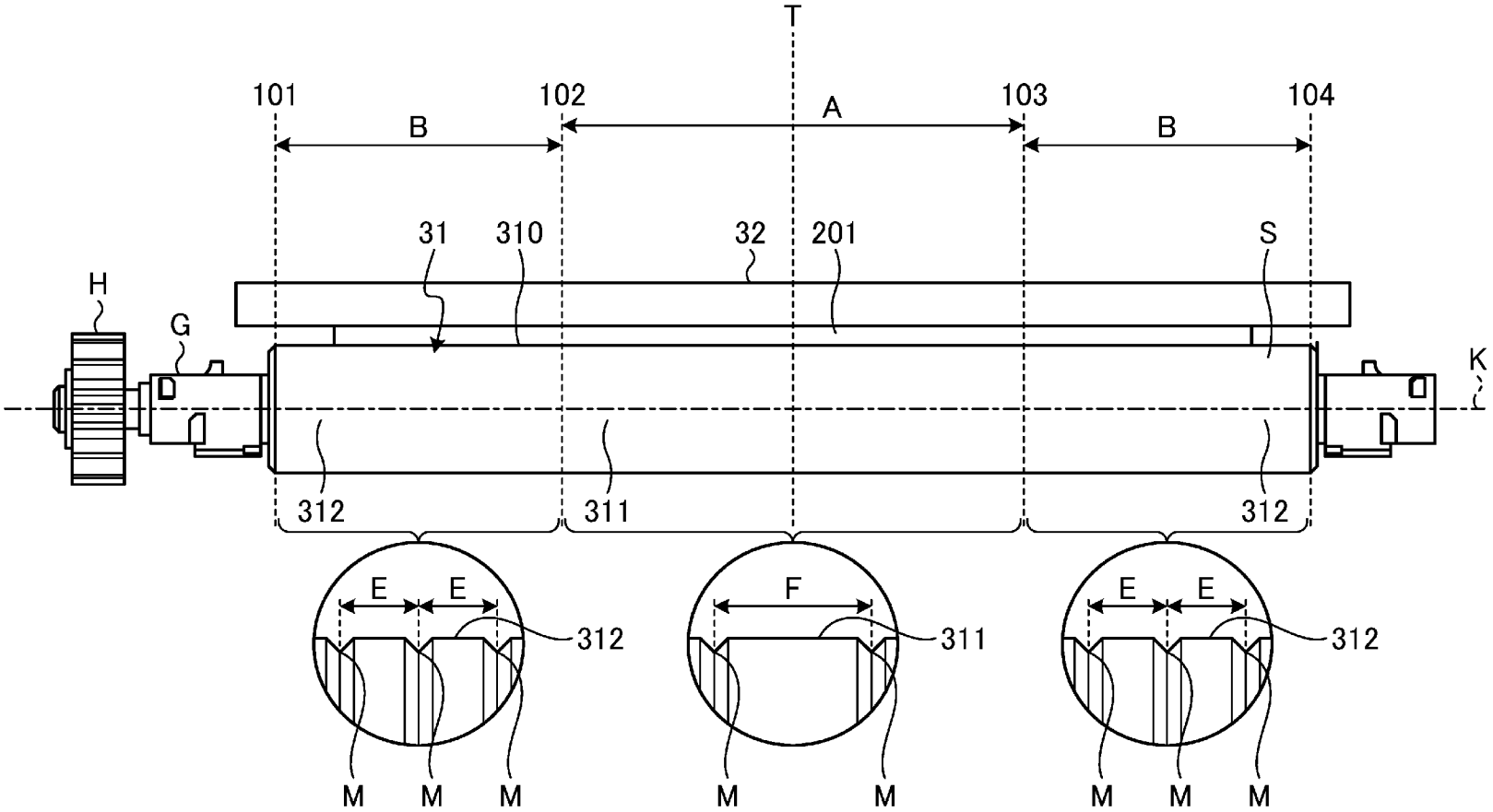
FIG. 4 illustrates an example of a structure of the platen.

Hereinafter, the embodiment will describe a case of a label 201 having a larger label width than the label 201 having the smallest label width. FIG. 4 illustrates an example of a structure of the platen 31. In FIG. 4, the platen 31 has the same configuration as that in FIG. 3. As illustrated in FIG. 4, when the platen 31 conveys the label 201 having a larger label width, the label 201 is in contact with the first outer peripheral portion 311 of the platen 31 and a front portion or a portion of each of the second outer peripheral portions 312 on both sides of the first outer peripheral portion 311. When the platen 31 rotates in this state, the label 201 is conveyed. At this time, in regions of the second outer peripheral portions 312, the print head 32 is not in direct contact with the platen 31, or has a small contact area with the platen 31 even if the print head 32 is in direct contact with the platen 31. In addition, the frictional resistance caused by sliding between the print head 32 and the platen 31 can be reduced by the grooves M provided in the second outer peripheral portions 312. Therefore, the platen 31 can stably convey the label 201.

Figure 5:
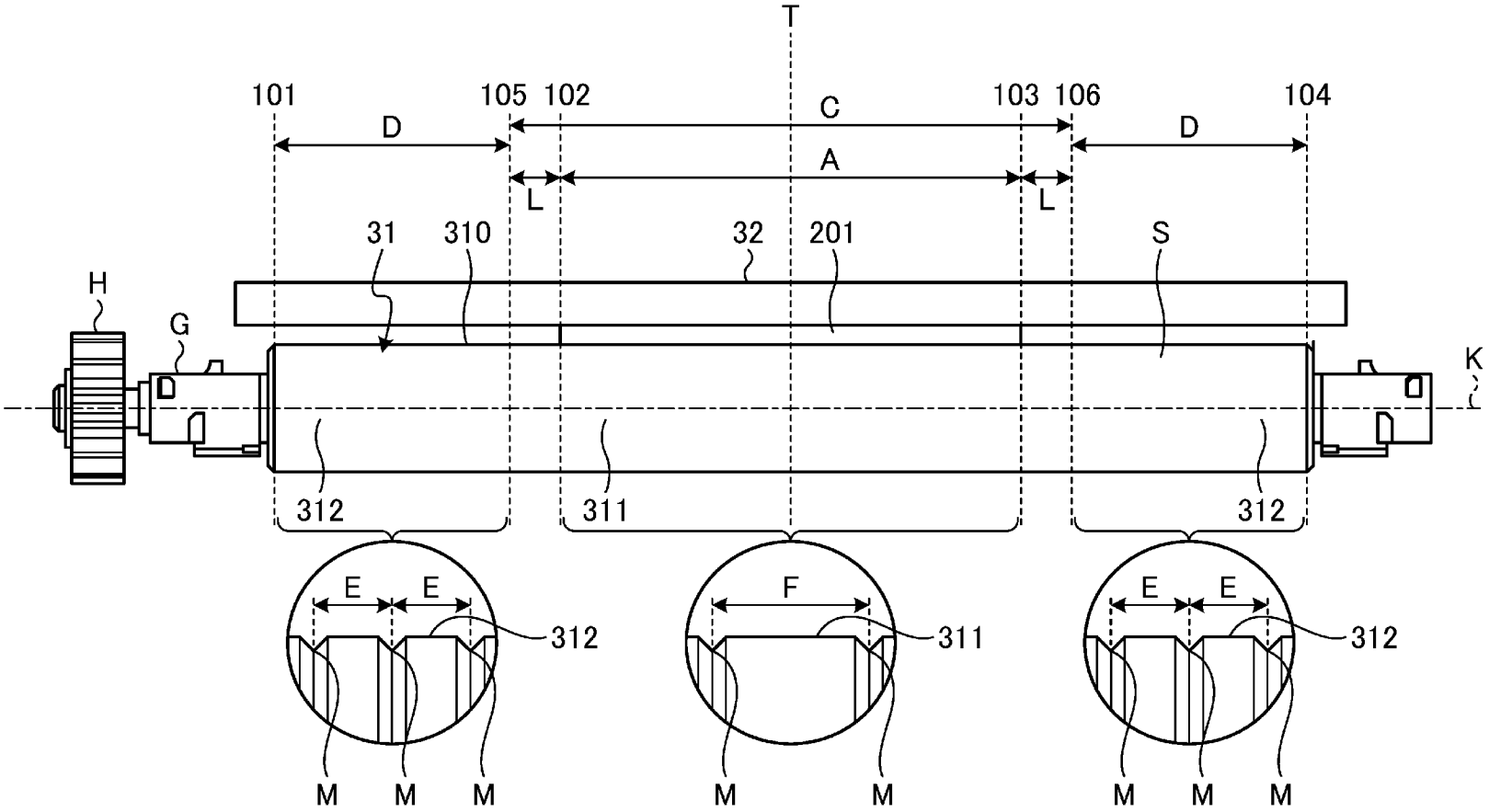
FIG. 5 illustrates a first modification of a structure of the platen.

Hereinafter, a first modification of the embodiment will be described. FIG. 5 illustrates the first modification of the structure of the platen 31. As described above, in regions close to both end portions of the label 201, the print head 32 is less likely to have a direct contact with the platen 31 due to an influence of sheet thickness of the label 201. Therefore, in the first modification, the second outer peripheral portions 312 are provided slightly away from a boundary portion with the label 201. That is, a region having a distance D (=distance B−distance L) between a dotted line 105, which is away from the dotted line 102 by a distance L, and the dotted line 101 is defined as the second outer peripheral portion 312. Then, a plurality of grooves M are formed in the second outer peripheral portion 312 between the dotted line 105 and the dotted line 101. Further, a region having a distance D (=distance B−distance L) between a dotted line 106, which is away from the dotted line 103 by the distance L, and the dotted line 104 is defined as the second outer peripheral portion 312. Then, a plurality of grooves M are formed at the interval E in the second outer peripheral portion 312 between the dotted line 106 and the dotted line 104. In this case, a region between the dotted line 105 and the dotted line 106 is the first outer peripheral portion 311, and a length of the first outer peripheral portion 311 satisfies distance A+distance L+distance L=distance C. In addition, a plurality of grooves M are formed at the interval F in the first outer peripheral portion 311.

In the first modification, the grooves M formed in the second outer peripheral portions 312 are formed at positions slightly away from the end portions of the label 201. Even in the first modification, the grooves M formed in the first outer peripheral portion 311 have the interval F, and the grooves M formed in the second outer peripheral portion 312 have the interval E smaller than the interval F. Therefore, a contact area with the print head 32 in the second outer peripheral portions 312 can be reduced, and thus frictional resistance caused by sliding with the platen 31 due to the rotation of the print head 32 in the second outer peripheral portions 312 can be reduced in the same manner as in the embodiment. Therefore, the platen 31 can stably convey the label 201.

Figure 6:
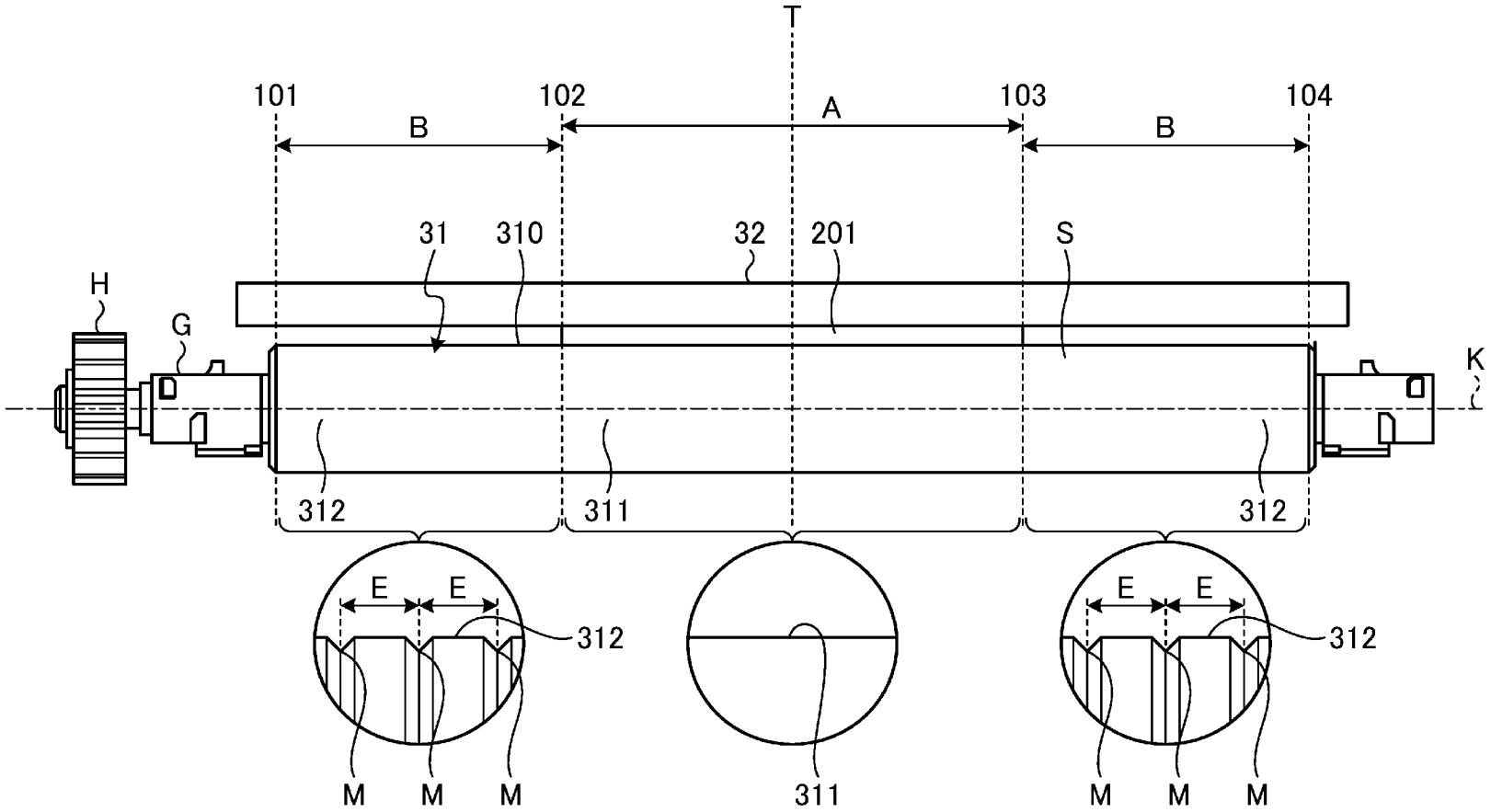
FIG. 6 illustrates a second modification of a structure of the platen.

Hereinafter, a second modification of the embodiment will be described. FIG. 6 illustrates the second modification of the structure of the platen 31. As illustrated in FIG. 6, in the second modification, no groove M is provided in the first outer peripheral portion 311. In the second outer peripheral portions 312, a plurality of grooves M are formed at the interval E in the same manner as in the embodiment. That is, in the second modification, the first outer peripheral portion 311 is in contact with the label 201 having the smallest width on the whole surface. On the other hand, a plurality of grooves M are formed in the second outer peripheral portions 312.

In the second modification, since the contact area with the print head 32 in the second outer peripheral portions 312 can be reduced in the same manner as in the embodiment, the frictional resistance caused by sliding with the platen 31 due to the rotation of the print head 32 in the second outer peripheral portions 312 can be reduced in the same manner as in the embodiment. In addition, the first outer peripheral portion 311 is in contact with the label 201 on the whole surface. Therefore, the platen 31 can stably convey the label 201.

Figure 7:
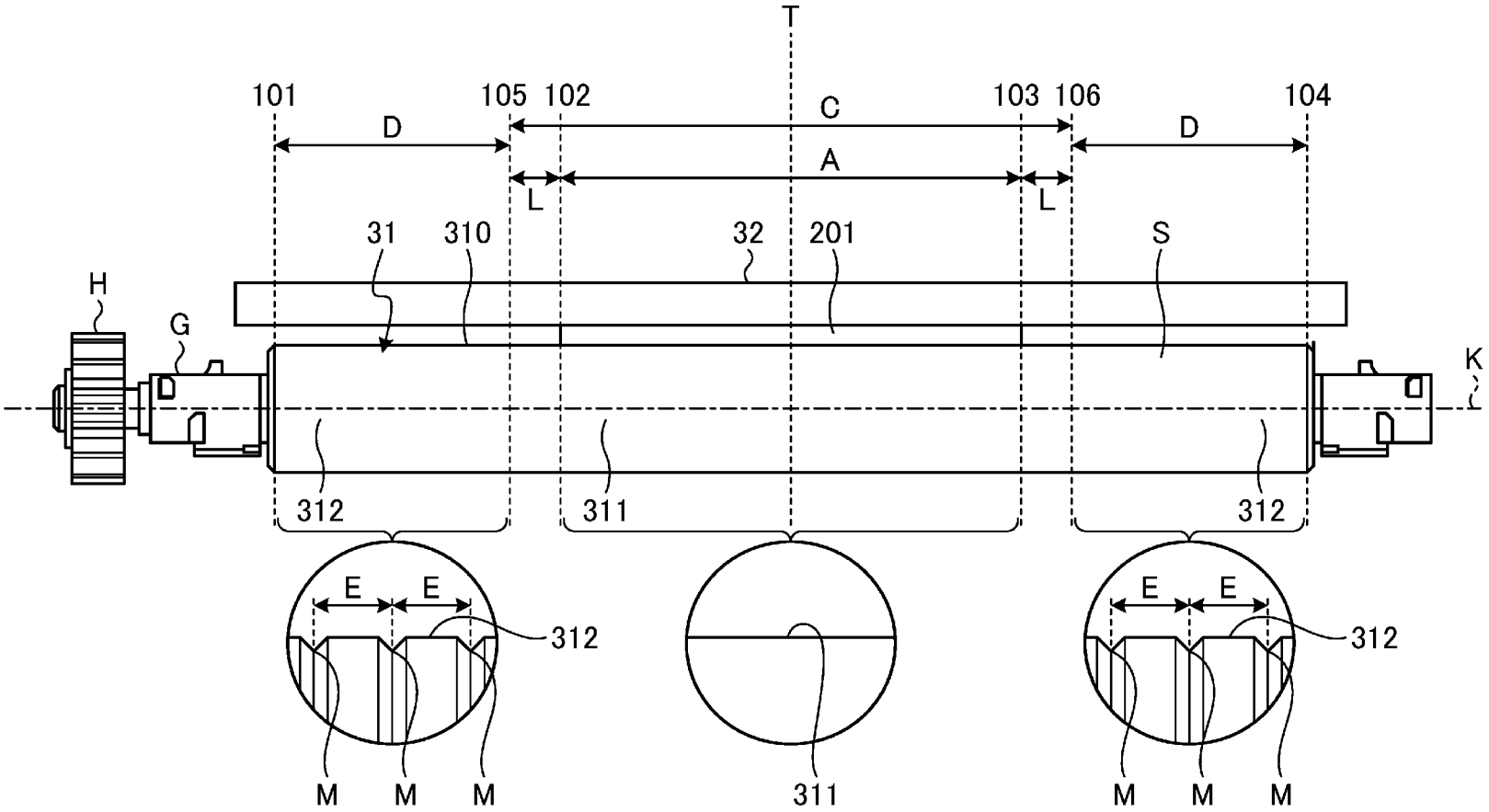
FIG. 7 illustrates a third modification of a structure of the platen.

Hereinafter, a third modification of the embodiment will be described. FIG. 7 illustrates the third modification of the structure of the platen 31. As illustrated in FIG. 7, in the third modification, no groove M is provided in the first outer peripheral portion 311. In the second outer peripheral portions 312, a plurality of grooves M are formed at the interval E in the same manner as in the first modification. That is, in the third modification, the first outer peripheral portion 311 is in contact with the label 201 having the smallest width on the whole surface. On the other hand, a plurality of grooves M are formed at the interval E in the second outer peripheral portions 312.

In the third modification, since the contact area with the print head 32 in the second outer peripheral portions 312 can be reduced in the same manner as in the embodiment, the frictional resistance caused by sliding with the platen 31 due to the rotation of the print head 32 in the second outer peripheral portions 312 can be reduced in the same manner as in the embodiment. In addition, the first outer peripheral portion 311 is in contact with the label 201 on the whole surface. Therefore, the platen 31 can stably convey the label 201.

As described above, the thermal printer 1 according to the embodiment includes: the platen 31 having a rotatable columnar shape and configured to convey the label 201 having various widths by bringing the label 201 into contact with the outer peripheral portion 310, the central portion T in the direction of the rotary shaft G being taken as a reference; and the print head 32 facing the platen 31, pressed by the outer peripheral portion 310, and configured to print by applying heat to the label 201 sandwiched between the print head 32 and the outer peripheral portion 310. In the outer peripheral portion 310 of the platen 31, the grooves M are formed in a direction intersecting the direction of the rotary shaft G in each of the second outer peripheral portions 312 on both outer sides with respect to the first outer peripheral portion 311 in contact with the label 201 having a smallest width that can be conveyed.

In the thermal printer 1 having such a configuration, the contact area between the print head 32 and the platen 31 in the second outer peripheral portions 312 can be reduced. Therefore, a load of sheet conveyance due to frictional resistance between the print head 32 and the platen 31 can be reduced.

While the embodiment and modifications are described above, the embodiment and modifications are presented by way of example only, and are not intended to limit the scope of the embodiment. The novel embodiment can be implemented in various other forms, and various omissions, substitutions, and modifications may be made without departing from the scope of the embodiment. The embodiment and modifications are included in the scope and the gist of the embodiment, and included in the inventions described in the claims and the scope of equivalents of the inventions.

For example, the embodiment and the first to third modifications describe that a plurality of grooves M are formed in the second outer peripheral portions 312. Alternatively, the embodiment is not limited thereto, and for example, a spiral groove M may be provided in the second outer peripheral portions 312. In this case, an interval between adjacent grooves M equals to the interval E. In this case, the spiral groove M provided in the second outer peripheral portion 312 on one side of the first outer peripheral portion 311 include spirals whose direction is opposite to a direction of spirals (bilaterally symmetrical) included by the spiral groove M provided in the second outer peripheral portion 312 on the other side of the first outer peripheral portion 311. In this way, for example, when a label 201 having a large width as illustrated in FIG. 4 is conveyed, the conveyed label 201 can be prevented from being biased in one direction due to an influence of a spiral shape.

In the embodiment, the grooves formed in the first outer peripheral portion 311 and the grooves formed in the second outer peripheral portion 312 are grooves M having the same shape. Alternatively, the embodiment is not limited thereto, and the grooves formed in the first outer peripheral portion 311 and the grooves formed in the second outer peripheral portions 312 may be different in shape (width of the groove, depth of the groove, angle of the groove, and the like).

As described in the embodiment, the label 201 is used as the print medium. Alternatively, the print medium is not limited thereto, and may be, for example, a linerless label, a piece of receipt paper, or a piece of cut paper.

In the embodiment, a plurality of grooves in the second outer peripheral portions 312 are uniformly formed at the interval E. Alternatively, the embodiment is not limited thereto, and for example, an interval between the plurality of grooves formed in the second outer peripheral portions 312 may be gradually narrowed toward both end portions of the platen 31. In this case, the interval of all the grooves formed in the second outer peripheral portions 312 is narrower than the interval F.

Other than in the operating examples, if any, or where otherwise indicated, all numbers, values and/or expressions referring to parameters, measurements, etc., used in the specification and claims are to be understood as modified in all instances by the term "about."

What is claimed is:

1. A thermal printer, comprising:

a platen having a rotatable columnar shape and configured to convey a print medium having various widths by bringing the print medium into contact with a first outer peripheral portion of the platen, a central portion of the platen in a direction of a rotary shaft of the platen being taken as a reference; and a print head facing the platen, pressed by the first outer peripheral portion of the platen, the print head configured to print by applying heat to the print medium sandwiched between the print head and the first outer peripheral portion of the platen, wherein the first outer peripheral portion of the platen has a first groove in a direction intersecting the direction of the rotary shaft in each of second outer peripheral portions on both outer sides in the direction of the rotary shaft with respect to the first outer peripheral portion in contact with the print medium having a smallest conveyable width.

2. The thermal printer according to claim 1, wherein the first groove comprises a plurality of grooves provided in the second outer peripheral portions at a first predetermined interval, and a second groove is present in the first outer peripheral portion at a second predetermined interval larger than the first predetermined interval.

3. The thermal printer according to claim 1, wherein the first groove comprises a plurality of grooves provided in the second outer peripheral portions at a first predetermined interval, and with the proviso that the first outer peripheral portion does not comprise a groove.

4. The thermal printer according to claim 1, wherein the first groove in the second outer peripheral portions and each of the second outer peripheral portions has a constant distance from the first outer peripheral portion to a corresponding one of the outer sides.

5. The thermal printer according to claim 1, wherein the first groove is a spiral groove provided at a first predetermined interval in the second outer peripheral portions.

6. The thermal printer according to claim 1, wherein the first groove comprises a plurality of grooves provided in the second outer peripheral portions and an interval between the grooves gradually decreases toward the both outer sides.

7. The thermal printer according to claim 1, wherein the first groove has a depth from 0.05 mm to 0.15 mm.

8. A label printer, comprising:

a platen having a rotatable columnar shape and configured to convey a print medium having various widths by bringing the print medium into contact with a first outer peripheral portion of the platen, a central portion of the platen in a direction of a rotary shaft of the platen being taken as a reference; and a thermal print head facing the platen, pressed by the first outer peripheral portion of the platen, the thermal print head configured to print by applying heat to the print medium sandwiched between the thermal print head and the first outer peripheral portion of the platen, wherein the first outer peripheral portion of the platen has a first groove in a direction intersecting the direction of the rotary shaft in each of second outer peripheral portions on both outer sides in the direction of the rotary shaft with respect to the first outer peripheral portion in contact with the print medium having a smallest conveyable width.

9. The label printer according to claim 8, wherein the first groove comprises a plurality of grooves provided in the second outer peripheral portions at a first predetermined interval, and a second groove is present in the first outer peripheral portion at a second predetermined interval larger than the first predetermined interval.

10. The label printer according to claim 8, wherein the first groove comprises a plurality of grooves provided in the second outer peripheral portions at a first predetermined interval, and with the proviso that the first outer peripheral portion does not comprise a groove.

11. The label printer according to claim 8, wherein the first groove in the second outer peripheral portions and each of the second outer peripheral portions has a constant distance from the first outer peripheral portion to a corresponding one of the outer sides.

12. The label printer according to claim 8, wherein the first groove is a spiral groove provided at a first predetermined interval in the second outer peripheral portions.

13. The label printer according to claim 8, wherein the first groove comprises a plurality of grooves provided in the second outer peripheral portions and an interval between the grooves gradually decreases toward the both outer sides.

14. The label printer according to claim 8, wherein the first groove has a depth from 0.05 mm to 0.15 mm.

15. A thermal printer, comprising:

a sheet holding unit comprising a shaft that holds a label sheet wound in a roll;

a platen having a rotatable columnar shape and configured to convey a label sheet having various widths by bringing the label sheet into contact with a first outer peripheral portion of the platen, a central portion of the platen in a direction of a rotary shaft of the platen being taken as a reference; and a print head facing the platen, pressed by the first outer peripheral portion of the platen, the print head configured to print by applying heat to the label sheet sandwiched between the print head and the first outer peripheral portion of the platen, wherein the first outer peripheral portion of the platen has a first groove in a direction intersecting the direction of the rotary shaft in each of second outer peripheral portions on both outer sides in the direction of the rotary shaft with respect to the first outer peripheral portion in contact with the label sheet having a smallest conveyable width.

16. The thermal printer according to claim 15, wherein the first groove comprises a plurality of grooves provided in the second outer peripheral portions at a first predetermined interval, and a second groove is present in the first outer peripheral portion at a second predetermined interval larger than the first predetermined interval.

17. The thermal printer according to claim 15, wherein the first groove comprises a plurality of grooves provided in the second outer peripheral portions at a first predetermined interval, and with the proviso that the first outer peripheral portion does not comprise a groove.

18. The thermal printer according to claim 15, wherein the first groove in the second outer peripheral portions and each of the second outer peripheral portions has a constant distance from the first outer peripheral portion to a corresponding one of the outer sides.

19. The thermal printer according to claim 15, wherein the first groove is a spiral groove provided at a first predetermined interval in the second outer peripheral portions.

20. The thermal printer according to claim 15, wherein the first groove comprises a plurality of grooves provided in the second outer peripheral portions and an interval between the grooves gradually decreases toward the both outer sides.

* * * * *